US010513822B2

(12) United States Patent
Rees et al.

(10) Patent No.: US 10,513,822 B2
(45) Date of Patent: Dec. 24, 2019

(54) VACUUM EXTRACTION PRINTING

(71) Applicant: ENGINEERED FLOORS LLC, Dalton, GA (US)

(72) Inventors: John Joseph Matthews Rees, Chattanooga, TN (US); Stephen Tsiarkezos, Elkton, MD (US); Dimitri Zafiroglu, Centreville, DE (US)

(73) Assignee: ENGINEERED FLOORS LLC, Dalton, GA (US)

( * ) Notice: Subject to any disclaimer, the term of this patent is extended or adjusted under 35 U.S.C. 154(b) by 0 days.

(21) Appl. No.: 15/979,945

(22) Filed: May 15, 2018

(65) Prior Publication Data

US 2018/0327967 A1 Nov. 15, 2018

Related U.S. Application Data

(60) Provisional application No. 62/506,146, filed on May 15, 2017.

(51) Int. Cl.
*D06P 5/20* (2006.01)
*D06P 7/00* (2006.01)

(52) U.S. Cl.
CPC ..... *D06P 5/2033* (2013.01); *D06P 7/00* (2013.01)

(58) Field of Classification Search
CPC ..... D06P 5/2033; D06P 7/00
See application file for complete search history.

(56) References Cited

U.S. PATENT DOCUMENTS

| | | | | |
|---|---|---|---|---|
| 3,536,005 | A | 10/1970 | Derrickson | |
| 4,056,057 | A | 11/1977 | Smith | |
| 4,299,591 | A * | 11/1981 | Gregorian | D06P 1/965 101/123 |
| 4,704,028 | A | 11/1987 | Richards, Sr. | |
| 5,730,919 | A | 3/1998 | Wilfong et al. | |
| 6,655,271 | B1 * | 12/2003 | Contompasis | B41F 17/003 101/125 |

OTHER PUBLICATIONS

Araki. Derwent 1995-307988, 1995.*
International Search Report and Written Opinion dated Sep. 4, 2018 in related International Application No. PCT/US2018/032676 (reference U.S. Pat. No. 3,536,005 was previously cited in IDS filed on Aug. 14, 2018).

* cited by examiner

*Primary Examiner* — Amina S Khan
(74) *Attorney, Agent, or Firm* — Patent Portfolio Builders PLLC

(57) ABSTRACT

Vacuum printing a fabric involves forming a fabric having a top face and a bottom face and placing a barrier layer below the top face. A plurality of holes is established in the barrier layer, and dye is applied to at least a portion of the top face of the fabric. Vacuum applied to the bottom face pulls the dye through the fabric and the plurality of holes in the barrier layer.

25 Claims, 7 Drawing Sheets

VACUUM EXTRACTION PRINTING

CROSS-REFERENCE TO RELATED APPLICATIONS

This application claims priority to U.S. Provisional Patent Application No. 62/506,146, filed May 15, 2017, the entire contents of which is incorporated herein by reference.

TECHNICAL FIELD

Embodiments of the subject matter disclosed herein relate to printing on textile sheets.

BACKGROUND

Coloring or printing patterns on textile sheets involves applying the desired dye, ink or ink patterns on the front or face of the textile sheet using methods such as spraying, screen transfer, or direct digital printing. The applied ink is expected to propagate toward the back of the textile sheet. If the applied ink does not propagate sufficiently through the depth of the textile sheet towards the back, fibers or yarns in the relatively bulky and deep textile sheet maintain their original color within the lower strata of the sheet. Furthermore, during the printing of a white fabric containing a relatively dense sublayer such as a film that is used to hold the fabric together, the film acts as a barrier, retarding or preventing the flow of ink from the front to the back of the fabric. The result is an undyed white face adjacent the back of the fabric. The undyed lower parts of the fabric can be visible when the face fibers are parted, exposing the bases of the fibers. In addition, the partial visibility or "shine-through" of the undyed portions of the fabric can dilute or modify the desired coloring or printing on the front of the fabric, losing "print sharpness". Moreover, an undyed layer remains visible under the fabric, and a line free of dye is exhibited at the cross-sectional interface at the cut edges.

Vacuum extraction systems are commonly used in the textile dyeing industry. Conventional vacuum extraction systems remove excess water or other liquid coatings from the fabric, reducing the amount of work in an oven or dryer by decreasing wet pick-up. Using vacuum extractors yields shorter ovens and reduced energy consumption. Vacuum extraction systems are also used to draw inks into and through fabrics. Vacuum rolls and vacuum belts are used under a wet or freshly printed sheet, and improvements to the printing equipment and the suction systems are illustrated, for example in U.S. Pat. Nos. 4,704,028 and 4,056,057. An attempt to concentrate vacuum using a narrow nozzle underneath the dye application zone is described in U.S. Pat. No. 3,536,005. However, vacuum applied to bulkier and thicker fabrics from the back face, at a distance from the front face equaling the thickness or depth of the fabric, is rarefied because of the depth or thickness of the fabric and may not pull the liquid evenly or sufficiently into or through the fabric if the fabric is highly air-permeable. Conversely if the fabric is highly impermeable, vacuum cannot pull sufficient air to help the dye propagate to the inner or back strata. Therefore, merely applying vacuum to a fabric may not achieve uniform penetration of dye into or through the entire fabric.

Therefore, a need exists for an improved method and system for printing relatively thick or bulky textile sheets that provides for the maintenance of a sharp image on the surface and for even and complete propagation of the ink from the front of the fabric face layer into the fabric and optionally to the back of the fabric.

SUMMARY

Exemplary embodiments are directed to using vacuum applied to the back of a bulky and thick fabric to pull ink evenly from the face of the fabric and optionally through the entire thickness of the fabric. The fabric contains within it a barrier layer located under the top surface, or a barrier layer attached to the back surface of the fabric. The barrier layer has a defined and discrete pattern of openings, perforations or holes. Preferably the pattern is a regular or even pattern. In one embodiment, the fabric formation process simultaneously inserts the ends of at least some of the fibers or yarns exposed on the face of the fabric into the holes or perforations. However, perforation of the barrier layer may not involve the insertion of fibers through the barrier layer. Perforation of the barrier layer also can be performed before or after the fabric is combined with or attached to the barrier layer. Perforation preferably increases the air permeability of the barrier by at least a factor of two. In one embodiment, a vacuum level of at least 24 inches of water is established locally under the fabric as the dye is applied or before the dye dries or sets. When vacuum is applied to the backside of the fabric, vacuum-induced air flow is channeled through the holes in the barrier layer and accelerated to a highly-increased speed. This channeling of the accelerated vacuum air flow pulls dye ink applied to the face layer through the holes in the barrier layer, i.e., along the Z-Axis, preferably through the entire fabric.

The ink that is pulled through the holes in the barrier layer may be pulled along the fibers or yarns originating from the face layer that have been carried through the holes. This concentrates the dye ink where most needed and uniformly distributes the dye ink from the front of the fabric to the back of the fabric.

Irrespective of whether face fibers or yarns pass through the holes in the originally impermeable or marginally permeable barrier, the perforated barrier helps maintain uniform air flow along the plane of the bulky and thick fabric.

Exemplary embodiments are directed to a method for printing a textile product and to the products printed in accordance with this method. A textile layer having a first face and a second face opposite the first face is combined with a barrier layer having low air permeability. The barrier layer is spaced from at least one of the first face and the second face. In one embodiment, the textile layer is combined with the barrier layer prior to establishing the plurality of holes, applying the dye and using vacuum. In one embodiment, the barrier layer is in contact with the second face of the textile layer. In one embodiment, a first textile layer and a second textile layer are combined with the barrier layer, and the barrier layer is disposed between the first textile layer and the second textile layer.

A plurality of holes is established in the barrier layer. In one embodiment, a sufficient number of holes is established to increase the air permeability of the barrier layer by a factor of at least two. In one embodiment, the holes in the plurality of holes have a uniform size in the barrier layer and are arranged in a uniform pattern across the barrier layer. In one embodiment, the holes in the plurality of holes have two or more sizes in the barrier layer and are arranged in a variable pattern across the barrier layer.

In one embodiment, the textile layer contains at least one of exposed fibers and exposed yarns on the first face, and establishing the plurality of holes further involves pushing at least one of the exposed fibers and the exposed yarns through the barrier layer to establish the plurality of holes. In one embodiment, the textile layer is a stitchbonded fabric containing yarns, and establishing the plurality of holes further involves stitching the yarns through the barrier layer. In one embodiment, the textile layer is a tufted fabric with a plurality at least one of individual fibers and yarns, and establishing the plurality of holes further involves using tufting needles to drive at least one of the individual fibers and yarns though the barrier layer. In one embodiment, the textile layer includes a fibrous layer having a plurality of at least one of fibers and yarns, and establishing the plurality of holes involves using an embossing tool to drive at least one of fibers and yarns through the barrier layer. In one embodiment, the textile layer is a needlepunched fabric with a plurality of fibers, and establishing the plurality of holes includes using a plurality of coarse needles to push fibers through the barrier layer.

Dye is applied to at least a portion of the first face of the fabric. In one embodiment, dye is applied to the first textile layer. Vacuum applied from the second face is used to pull the dye through the textile layer and the plurality of holes in the barrier layer. In one embodiment, vacuum applied from the second textile layer is used to pull the dye into or through the first textile layer and the plurality of holes in the barrier layer. In one embodiment, vacuum is applied uniformly across the second face of the textile layer. In one embodiment, vacuum is applied to the second face at more than 25 cm of water. In one embodiment, vacuum is applied simultaneously at different levels in different areas across the second face. In one embodiment, vacuum is applied sequentially to a plurality of discrete locations across the second surface.

The dye contained with the textile layer is set. In one embodiment, the textile product is compressed after applying dye and using vacuum and before setting the dye. In one embodiment, a plurality of levels of compression is used. Each level of compression is applied at a discrete location across the second face. In one embodiment, compressed air is blown onto the applied dye before, during or after the application of vauum.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Exemplary embodiments are directed to improved printing of a textile product. Suitable textile products include, but are not limited to, fabrics and floor coverings. The textile product includes at least one textile layer and a barrier layer in contact with the textile layer. In particular, exemplary embodiments are directed to methods for printing textile products using vacuum assisted printing. A limited amount of fluid, e.g., dye, is placed onto the top or exposed face of a textile layer, and vacuum applied to the bottom face facilitates uniform propagation of the fluid through the textile layer towards the bottom face with minimum change in planar distribution of the fluid placed on the top face. In one embodiment, the textile layer is formed independent of the formation and attachment of additional layers of the textile product including the barrier layer used for vacuum assisted printing. Alternatively, the textile layer is formed concurrent with the addition of the barrier layer and establishing the plurality of holes in the barrier layer.

In one embodiment, the textile layer is a needle-punched fabric containing a plurality of fibers and combined with the barrier layer. In one embodiment, the needle-punched fabric includes two layers, a first layer placed on a first side of the barrier layer and a second layer placed on a second side of the barrier layer opposite the first side. The first and second layers are needled-punched, forcing fibers through the barrier layer and simultaneously perforating the barrier layer. In one embodiment, the textile layer is a tufted fabric. A solid or highly impermeable barrier layer is located above, within, or below the primary backing of the tufted fabric and is perforated by tufting needles during the tufting process.

In one embodiment, the textile layer is a stitch-bonded fabric. The solid or highly impermeable barrier layer is contained within, is placed above or below a face of the stitch-bonded fabric or functions as the stitching substrate. The bather layer is perforated during the stitchbonding process by the stitch-bonding needles.

Figure 1:
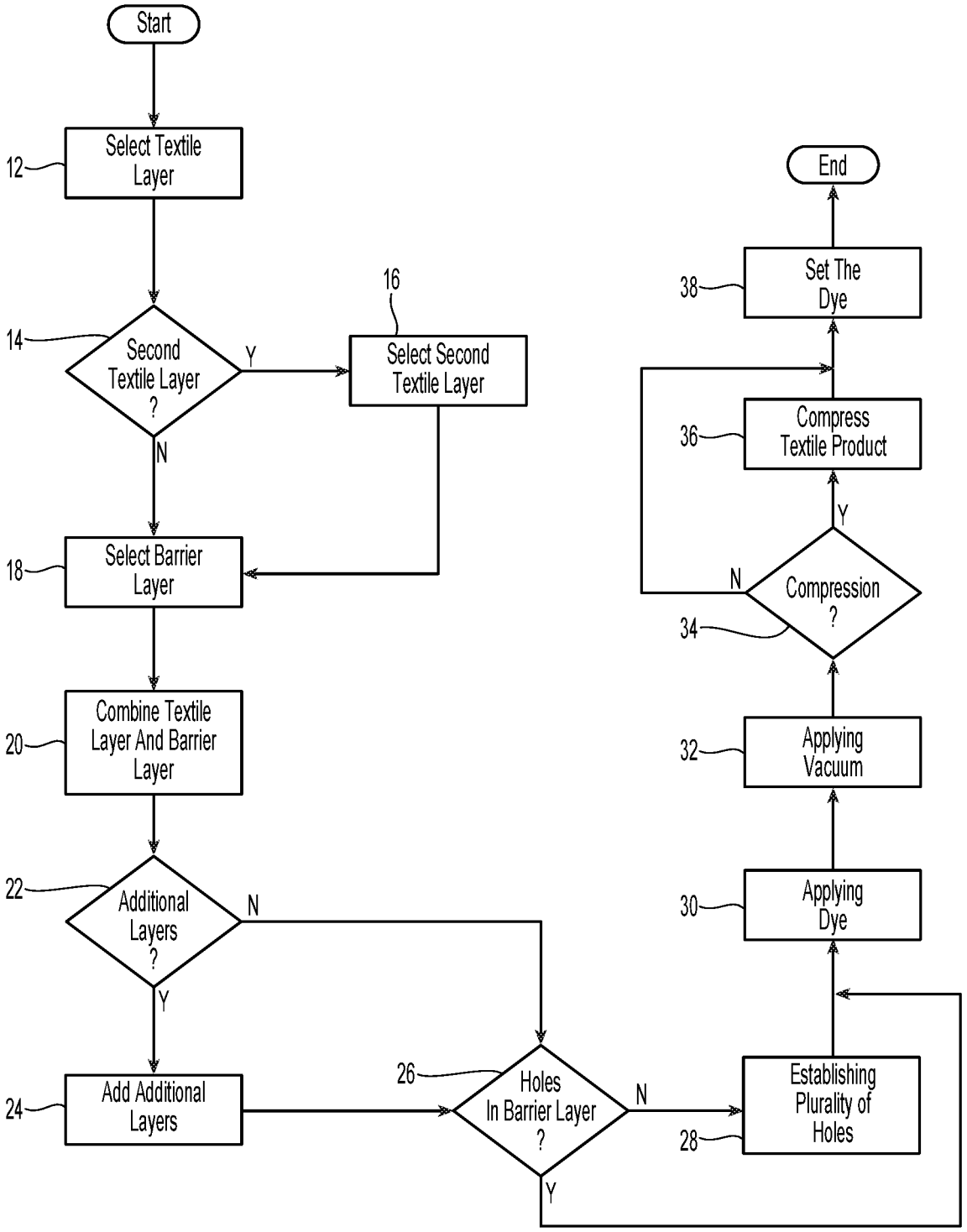
FIG. 1 is a flow chart illustrating an embodiment of a method for vacuum assisted printing of a textile product.

Referring initially to FIG. 1, exemplary embodiments are directed to a method for printing a textile product 10. The desired type of textile layer is selected 12. Suitable tetile layers include, but are not limited to, felts, stitch-bonded fabrics, needle-punched fabrics, bulked fabrics, tufted fabrics, embossed fabrics, brushed woven fabrics and knit fabrics. In one embodiment, the textile product includes a single textile layer. Alternatively, the textile product can include more than one textile layer. Therefore, a determination is made regarding with a second textile layer is to be included 14. If a second textile layer is to be included, then the second textile layer is selected 16. In one embodiment, the second textile layer is different than the first textile layer. In another embodiment, the second textile layer is the same as the second textile layer. In one embodiment, the first and second textile layers function as two halves of a single textile layer. Each textile layer includes a first face or side and a second face or side opposite the first face. The first and second faces can each correspond to the technical top or bottom of the textile layer.

Having selected the textile layers, the desired type of barrier layer is selected 18. The barrier layer is a barrier to liquid penetration and has low air permeability or zero air permeability. Suitable barrier layers include, but are not limited to, thin polymer sheets. In one embodiment, the barrier is a solid film prior to the perforating process. Alternatively, the barrier layer includes an arrangement of holes or perforations. In one embodiment, the barrier is initially a completely impermeable film, i.e., zero permeability. In one embodiment, the barrier layer is originally a fabric or membrane of very low liquid and air permeability. In addition to a single barrier layer, the textile product can include a plurality of barrier layers, including a plurality of identical barrier layers and a plurality of different barrier layers.

The textile layer is combined with the barrier layer 20. The barrier layer is combined with the textile layer such that the barrier layer spaced from at least one of the first face and the second face. Therefore, the barrier layer can be in contact with the first face or the second face. Alternatively, the barrier layer is disposed within the textile layer and spaced from the first and second faces. When the barrier layer is in contact with the first face or second face, the barrier layer can cover the face or can be located within the textile layer just under the face. In one embodiment, the barrier layer is placed below the back face of the textile layer, for example, in contact with the back of the textile layer. The barrier layer may be placed within the textile layer during the formation of the textile layer. Alternatively, the barrier layer is placed in contact the textile layer after formation of the textile. In one embodiment, the barrier layer is attached to the bottom surface of the textile layer to facilitate application of vacuum from the backside of the textile layer following application of fluid or dye to the front side or face of the textile layer.

When the textile product includes two textile layers, e.g., a first textile layer and a second textile layer, the barrier layer is disposed between the first textile layer and the second textile layer. Alternatively, the barrier layer can be spaced from at least one of the first face and the second face of either the first or second textile layer. In one embodiment, at least two barrier layers are combined with two textile layers, and each barrier layer is spaced from at least one of the first face and the second face of one of the textile layers. In one embodiment, the textile layer and the barrier layer are combined prior to further processing of the textile product including establishing holes, applying the dye and using vacuum.

In one embodiment, a determination is made regarding whether additional layers are to be included in the textile product 22. Suitable additional layers include, but are not limited to, backing layers and cushioning layers. If additional layers are to be included, those layers are added to the combined textile layer and barrier layer 24. A determination is then made regarding whether holes are to be created or established in the barrier layer 26. If the barrier layer was selected to have the desired permeability qualities or already includes holes or perforations, than additional holes in the barrier layer may not be required.

If holes or perforations are needed in the barrier layer, then a plurality of holes is established in the barrier layer 28. In one embodiment, a sufficient number of holes are established in the barrier layer to increase the air permeability of the barrier layer by a factor of at least two. The plurality of holes can have a uniform or identical size and shape. In addition, the plurality of holes can be established in accordance with a uniform pattern across the barrier layer. Alternatively, the plurality of holes includes holes having two or more sizes or shapes. In addition, the plurality of holes is established in the barrier layer in accordance with a variable pattern, i.e., a pattern that varies regularly or randomly across the barrier layer. In one embodiment, the plurality of holes is established randomly. In general, the plurality of holes is established according to a desired pattern across the barrier layer. Suitable patterns include patterns that are uniform across the barrier layer and patterns that vary, for example, in hole density, across the barrier layer. In one embodiment, the plurality of holes is established in the barrier layer before the barrier layer is combined with the textile layer. Alternatively, the plurality of holes is established in the barrier layer during formation or creation of the textile layer.

In one embodiment, the plurality of holes is established by selectively perforating the barrier layer with a pattern arranged to direct the flow of air through the barrier using mainly or exclusively the plurality of holes. In one embodiment, fibers or yarns originating from the strata above or adjacent the barrier layer, i.e., strata of the textile layer, penetrate the barrier layer through the perforations and facilitate the propagation of liquid to the lower strata. In one embodiment, the fibers from the textile layer are pushed through the barrier layer, penetrating the bather layer and reaching the bottom of the textile layer or the textile product in the textile layer.

In one embodiment, the textile layer contains at least one of exposed fibers and exposed yarns on the first face, and establishing the plurality of holes involves pushing at least one of the exposed fibers and the exposed yarns through the barrier layer to establish the plurality of holes. In one embodiment, the textile layer is a stitchbonded fabric containing yarns, and establishing the plurality of holes involves stitching the yarns through the barrier layer. In one embodiment, the textile layer is a tufted fabric, and establishing the plurality of holes involves tufting the yarns though the barrier layer. In one embodiment, the textile layer is a fibrous layer having a plurality of fibers, and establishing the plurality of holes further uses an embossing tool to drive fibers through the barrier layer. In one embodiment, the textile layer is a needlepunched fabric having a plurality of fibers, and establishing the plurality of holes further uses a plurality of coarse needles to push fibers through the barrier layer.

Initially, the barrier is impermeable or has low permeability, and the permeability of the barrier layer is increased by perforating the composite of the textile layer or textile layers and barrier layer following combination or lamination of the barrier layer to the textile layer. In one embodiment, attachment of the barrier layer to one of the faces, e.g., the backside, of the textile layer is performed by inserting groups of fibers from the fibrous layer into a semi-permeable or impermeable barrier layer by needle-punching, preferably without forming a contiguous sheet under the barrier.

In one embodiment, the fibers inserted through the fibrous layer of the textile layer and the barrier layer are provided by an additional thin overlayer attached to the original fibrous layer of the textile. In one embodiment, attachment of the barrier layer to the textile layer includes pattern-lamination, and the permeability of the barrier layer is increased by punching through the barrier layer during the lamination process. In one embodiment, fibers or yarns originating from the strata above or adjacent the barrier layer penetrate the barrier layer through the perforations and facilitate the propagation of liquid to the lower strata of the fabric below the barrier layer. In one embodiment, fibers penetrating the barrier layer reach the bottom of the composite fabric.

In one embodiment, the barrier layer has a variable permeability across the face of the barrier layer, i.e., the permeability of selected areas varies compared to other areas. Therefore, dye penetration through the fabric after the application of vacuum varies according to a desirable decorative or functional pattern defined by the variable permeability.

Once the barrier layer has the desired number and pattern of holes, dye is applied to at least a portion of the first face of the fabric 30. Any suitable method for applying dye to a textile product that is known and available in the art can be used. When the textile product includes a first textile layer and a second textile layer, dye is applied to the first textile layer. In one embodiment, liquid dye is applied uniformly to at least a portion of the first face of the textile layer. In one embodiment, the dye is placed on the first face or surface of the textile layer uniformly across the plane of the first face. Alternatively, dye is placed on the first face in accordance with a pattern differing from one area of the first face to another. In in embodiment, the pattern is defined by selective placement of dyes of assorted colors. In one embodiment, the dye is applied onto the overlaps of the textile layer and forced to propagate to the underlaps. Alternatively, the dye is applied to the underlaps and forced to propagate to the overlaps, for example, of a stitchbonded fabric textile layer.

In one embodiment, dye is applied uniformly or in accordance with the predefined pattern that varies across the first face of the textile layer. The perforations or holes are arranged in a different pre-defined pattern to produce a varying degree of dye tone in different areas on the first and second faces of the textile layer.

Having applied the dye, vacuum is applied 32 from the second face to pull the dye through the textile layer and the plurality of holes in the barrier layer. In one embodiment where the textile product includes first and second textile layers, vacuum is applied from the second textile layer to pull the dye through the first textile layer and the plurality of holes in the barrier layer. In one embodiment, vacuum is applied uniformly across the second or bottom face of the textile layer. In one embodiment, vacuum is applied to the second face at more than about 25 cm of water. In one embodiment, vacuum is applied simultaneously at different levels in different areas across the second face. In one embodiment, vacuum is applied sequentially to a plurality of discrete locations across the second face.

In general, vacuum is used to pull dye through the textile layer and holes in the barrier layer, and the vacuum is applied onto the second face or bottom surface of the textile layer or textile product to force air to accelerate through the perforations or holes and drag the fluid, e.g., dye, placed on the top face to propagate uniformly to the second face or bottom of the textile layer. In one embodiment, an air jet is applied to the top face of the fabric prior to or simultaneously with the application of vacuum to the bottom face.

Suitable methods for applying vacuum include, but are not limited to, using a porous belt carrying the textile layer with vacuum applied under the belt, using a perforated vacuum roller and using a traveling vacuum nozzle. In one embodiment, vacuum is applied selectively across the textile layer in a predefined pattern to vary the amount of penetration of fluid, i.e., dye, in different areas of the textile layer. In one embodiment, the distribution of color and depth of color is controlled on both the first and second faces by the degree of vacuum applied to different areas of the textile layer. The application of vacuum can optionally be performed at different levels, to different areas, at different times. In one embodiment, compression is applied uniformly to the entire textile layer or to different degrees in different areas of the textile layer after the application of vacuum to control the depth of color on either face.

In one embodiment, pressure is applied on the top or first face of the textile layer simultaneously with vacuum applied from the bottom or second face. In one embodiment, this positive pressure is applied by physical contact. Alternatively, the pressure is applied with compressed air blown onto the first face of the fabric.

In one embodiment, the vacuum system utilizes a travelling suction nozzle to vacuum ink through the textile layer in unison with the jetting or application of dye onto a first face of the textile layer. In this embodiment, the suction nozzle tracks and mirrors the travel of the printing head and is located directly below the printing head through the textile layer.

In one embodiment, vacuum is applied by a perforated vacuum roller. The vacuum roller tracks the application of dye or printing, for example by a print head as it moves across the first face of the textile layer. The vacuum roller is positioned close to or right after the printing zone. Therefore, the vacuum roller follows the printing, and applies vacuum immediately after application of the dye.

In one embodiment, a pin roller is used prior to at least one of printing and vacuuming to perforate the textile layer and the enclosed or attached barrier layer. The textile layer is run over the roller backed by a soft counter-roller. In one embodiment, a manifold system such as a manifold air distribution plate us utilized adjacent the second face or back to direct or redirect the flow of air or vacuum across the back of the textile layer.

Having applied the dye and used vacuum to draw the dye through the textile layer and the plurality of holes in the barrier layer, a determination is made regarding whether or not the textile layer is to be compressed 34. The textile layer is compressed to spread out the fluid, e.g., dye, propelled through the barrier layer laterally within the strata of the textile layer located under the barrier layer. If the textile layer is to be compressed, the textile layer is compressed 36 to promote the horizontal spreading of the dyes into the fibers or yarns located at the opposite face under the barrier. In one embodiment, the textile product is compressed after applying dye and using vacuum and before setting the dye. In one embodiment, the textile product or textile layer is compressed using a plurality of levels of compression. Each level of compression is applied at a discrete location across the second face or bottom surface. After compression, or if the textile layer or textile product is not compressed, the dye is set 38. Suitable methods for setting the dye are known and available in the art. The resulting textile product, colored or patterned by the dye can then be incorporated as a dyed textile layer or textile product in, for example, a floor covering.

Figure 2:
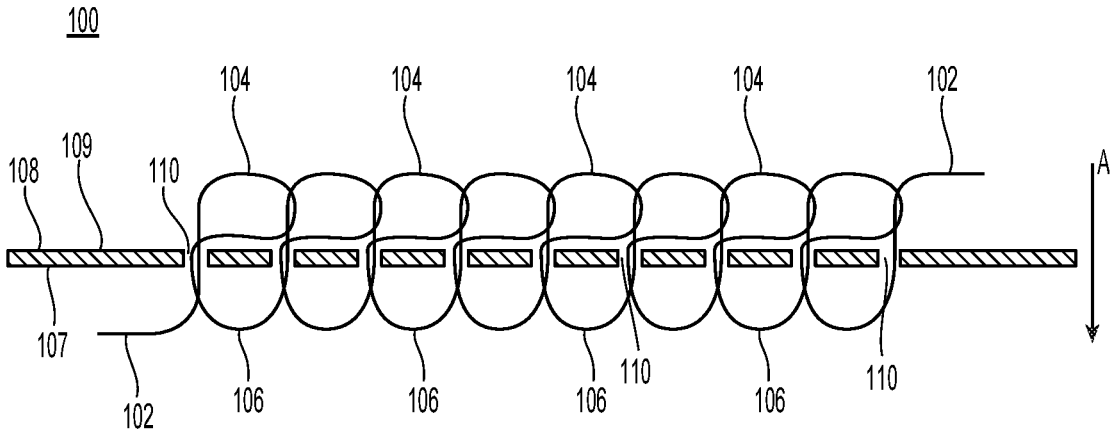
FIG. 2 is a schematic representation of an embodiment of a stitchbonded fabric containing a barrier layer.

Exemplary embodiments are also directed to textile layers, textile products and floor covering made, printed and colored in accordance with the methods described herein. Referring to FIG. 2, an embodiment of a textile product having a textile layer that is a stitchbonded fabric 100 is illustrated. The stitching forms "overlaps", i.e., loops, 104 of yarns 102 on a first or outer side 109 of a barrier layer 108 through which the yarns are stitched. Suitable barrier layers include solid thin films and breathable membranes that allow water vapor through but resisting high velocity air penetration. Stitching also forms "underlaps" 106, also referred to as loops of yarns 102 on a second or inner side 107 of the barrier layer opposite the first side. Stitching forms the overlaps and underlaps by pushing the yarns through the barrier layer, creating or forming a plurality of holes 110 in the barrier layer. The plurality of holes forms a regular pattern in two dimensions across the barrier layer. In one embodiment, the stitchbonded fabric also includes additional layers that are thin air-permeable layers (not shown) located adjacent the first and second sides of the bather layer. Suitable thin air-permeable layers include, but are not limited to, traditional webs of filaments or staple fibers.

The stitchbonded fabric, with or without the presence of thin air-permeable layers, is a relatively bulky textile product. In one embodiment, the textile product is further bulked by allowing the substrate layer or layers to shrink after stitching, thereby raising the stitched overlaps and underlaps. Printing or coloring the stichbonded fabric includes placing dyes on the "overlaps" and setting the dyes by exposing the fabric to heat. The dyes, however, tend to remain near the top surface and to be blocked by the barrier layer. Therefore, the dyes do not propagate through to the opposite side of the barrier layer. Moreover, the dyes may also fail to propagate sufficiently down through the "overlaps" toward the film. As the yarn loops do not necessarily intermesh to cover the entire area of the stitchbonded fabric, lines, representing areas that are free of dye, may also appear on the "overlap" side of the barrier layer.

Exemplary embodiments utilize the plurality of holes formed in the barrier layer during the stitching process in combination with the application of vacuum to the second face or bottom of the textile layer and the application of dye to the "overlaps" to pull the dye pattern through the overlaps toward the plurality of holes. This distributes the dye completely through the "overlaps" of the stitchbonded fabric. In addition, the dye is pulled through the plurality of holes and along the yarns passing through the plurality of holes, for example, in the direction indicated by arrow A, which allows the dye to reach the second side of the barrier layer and the "underlaps". The perforated barrier layer allows a high vacuum to be maintained, and air, along with dye, to be pulled at a high air velocity through the holes or perforations. Therefore, the plurality of holes, in the regular pattern covering the stitchbonded fabric, not only helps to pull the dye through all the "overlaps" but also establishes and maintains a uniform vacuum throughout the surface of the fabric. This relatively high air velocity drags the dye solution or suspension through the perforations, i.e., the plurality of holes, coloring the entire overlaps and eliminating the occasional color-free lines from the exposed overlap face. Moreover, a sufficient and controllable amount of dye is pulled through to the "underlaps". With dye on the second side of the barrier layer, this dye, which is now in the lower strata, can optionally be further dispersed throughout the "underlaps" in both the planar and normal directions. This eliminates the thin white under-edge that can develop at the cut edges 122 (FIG. 3) in the subsequently assembled flooring product. Coloring of the "underlaps" is also accomplished without smudging the exposed "overlap" face because the dyes are not loose on the overlaps.

Figure 3:
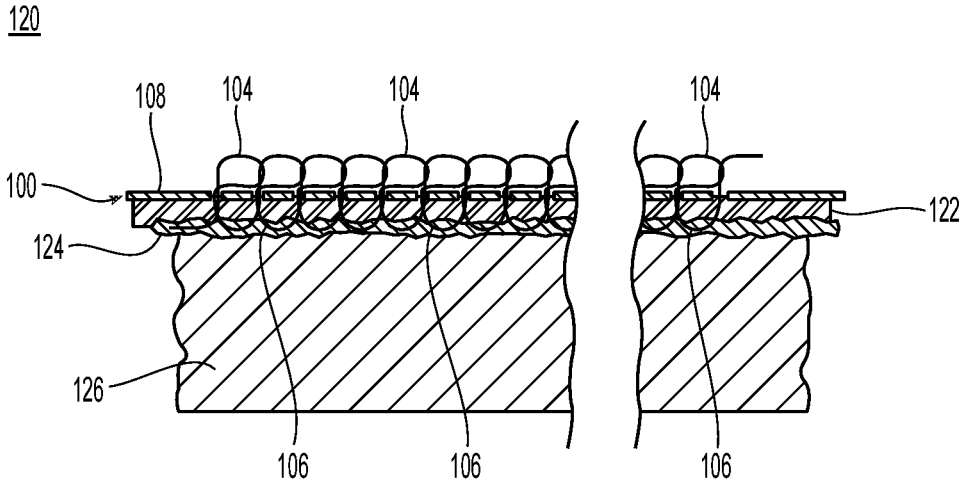
FIG. 3 is a schematic representation of the stitchbonded fabric of FIG. 1A incorporated into a floor covering.

In one embodiment illustrated by FIG. 3 the fabric 100 of FIG. 2 is shown attached through an adhesive layer 124 to a backing 126 to serve as a floorcovering or wallcovering or cushioning upholstery fabric. The edges 122 do not show an undyed sublayer as the dyes have penetrated the entire fabric 100 with the help of the vacuum through the perforated barrier layer 108.

Figure 4:
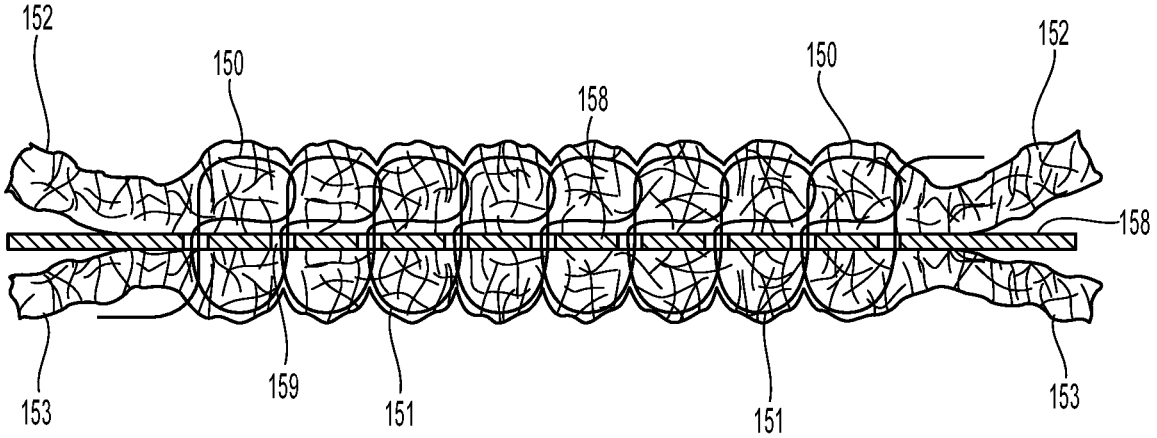
FIG. 4 is a schematic representation of another stitchbonded fabric containing a barrier layer.

In another embodiment illustrated by FIG. 4, the overlaps 150 or underlaps 151 of the stitchbonded fabric may be pulled into the body of additional relatively thick fibrous layers 152 or 153 that may be present over or under the barrier layer 158. Therefore when dye is placed on one face or the other, that dye may initially reside on the protruding parts of the fibrous layers 152 or 153. Upon the application of vacuum from the opposite side or face, the barrier layer 158 that is perforated by stitching guides the dyes though the perforations 159.

In another embodiment, the process described above in connection with the textile products of FIGS. 2 and 4 can also be reversed by applying the dye from the underlap side and promoting the uniform propagation of dye to the overlap side.

Figure 5:
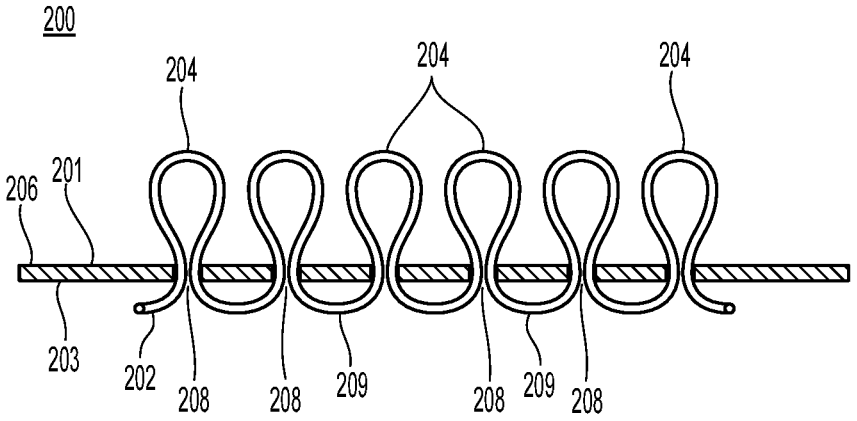
FIG. 5 is a schematic representation of an embodiment of a loop-pile fabric tufted through a primary backing.

Referring now to FIG. 5, another embodiment is shown involving a tufted fabric 200 having a primary backing 206 which, unlike ordinary woven or nonwoven primary backings, is purposely chosen to be impervious or highly air-flow penetration resistant. Therefore, the primary backing acts as a barrier layer. Perforations or holes 208 are formed in the bather layer by tufting needles that push the yarns 202 through the barrier layer, forming the pile loops 204 on the top side 201 of the barrier layer and the backlaps 209 on the bottom side 203 of the barrier layer opposite the top side.

Figure 6:
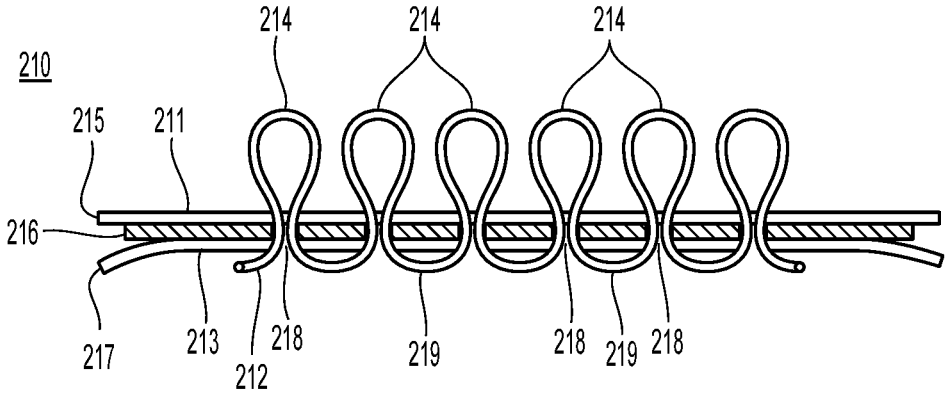
FIG. 6 is a schematic representation of another embodiment of a loop pile fabric where the primary backing is surrounded with optional highly-impermeable barrier overlays.

Referring to FIG. 6, another embodiment of a tufted fabric 210 having two impervious or air-penetration resistant barrier layers 215 and 217 placed above and below a regular and air-permeable primary backing 216, is illustrated. The perforations or holes 218 are formed in the barrier layers with tufting needles that push the yarns 212 through the primary backing and the barrier layers, forming the pile 214 or loops on the top side 211 of the layers, and the backlaps 219 on the bottom side 213 of the barrier layers opposite the top side. The holes 218 are formed and the yarns 202 pass through these additional barrier layers. Vacuum is applied to the tufted product on the backlap side, pulling dye through the pile toward the plurality of holes and along the yarns extending through the holes. This pulls the dye into and through the backlaps. The embodiment illustrated in FIG. 6 can also contain only one barrier layer, placed above or below the original primary backing depending upon the desire to direct dye flow primarily over the primary backing or into it.

Since traditional primary backing layers in tufting are typically formed of woven yarns, woven ribbons or nonwovens, the permeability of the primary backing layer is high. Perforation by the tufting needles changes the air permeability by a very small percentage. While high air permeability for a tufted structure that is dyed is intuitively assumed to be necessary to allow a lot of vacuum-pulled air through, this high permeability can work against the propagation of dyes through the holes in the primary backing layer by failing to direct the vacuum air flow along the pile loops and to maintain a relatively high vacuum to provide uniform air flow throughout the fabric plane. The additional barrier layers increase the effectiveness of the plurality of holes in directing the flow of dye. A single added barrier layer can also serve the same purpose.

Figure 7:
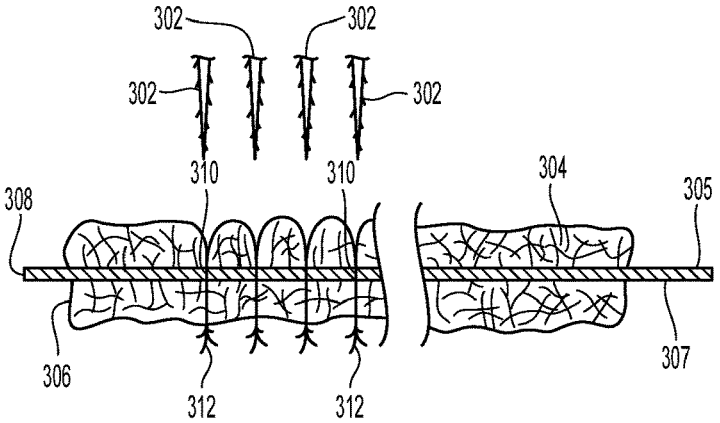
FIG. 7 is a schematic representation of an embodiment where two fiber layers surround a barrier layer before needle-punching.
Figure 8:
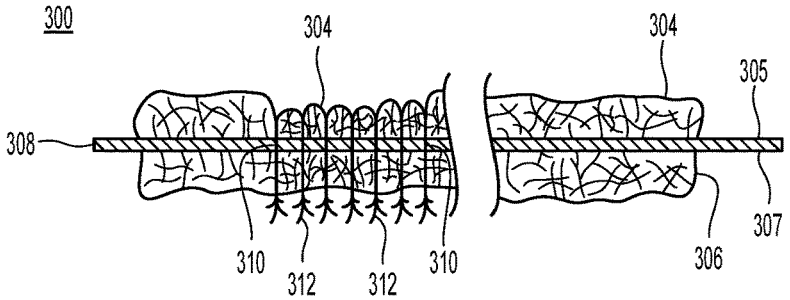
FIG. 8 is a schematic representation of an embodiment of a needle-punched fabric containing a barrier layer.

Exemplary embodiments of improved coloring and printing of textile products also include the application of the exemplary methods to needle-punched fabrics. Referring to FIG. 7, a textile product having first and second textile layers and a barrier layer disposed between the first and second textile layers is illustrated. As illustrated, an upper fibrous layer 304 is placed on an upper face 305 of an impervious or low-air permeable barrier layer 308, and a lower fibrous layer 306 is placed on the lower face 307 of the barrier layer 308 opposite the upper face. A plurality of needle-punching needles 302 are passed through the upper fibrous layer, perforating the barrier layer and forming a plurality of holes 310. In addition, the needle-punching needles carry or push individual fibers 312 from the upper fibrous layer into the lower fibrous layer. Repeated needling results in the needle-punched fabric 300 (FIG. 8). In one embodiment, the barrier layer is a vapor-permeable membrane that allows a very limited amount of fluid flow through the membrane. The permeability of this membrane is increased by the needling.

As with the other fabrics, vacuum is applied to the lower fibrous layer of the needle-punched fabric, pulling dye through the upper fibrous layer toward the plurality of holes and along the individual fibers extending through the holes. This pulls the dye into and through the lower fibrous layer. In one embodiment dye is placed on the bottom layer 306 and vacuum is applied from the top layer 304.

In another embodiment the lower fibrous layer 306 in FIG. 7 is absent, and only tufts of fibers driven through the barrier 308 are present under the barrier. In one embodiment dye is applied from the face side of the upper fibrous layer 304 and vacuum is applied from the opposite side. In one embodiment dye is placed on the opposite side and pulled with vacuum applied from the face side of the upper fibrous layer 304.

Figure 9:
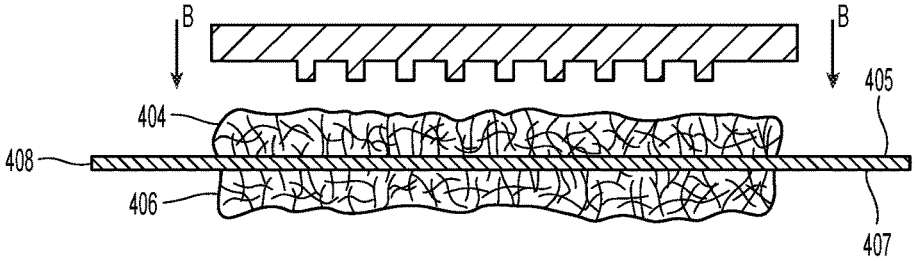
FIG. 9 is a schematic representation of an embodiment of an embossed fabric containing a barrier layer before embossing.
Figure 10:
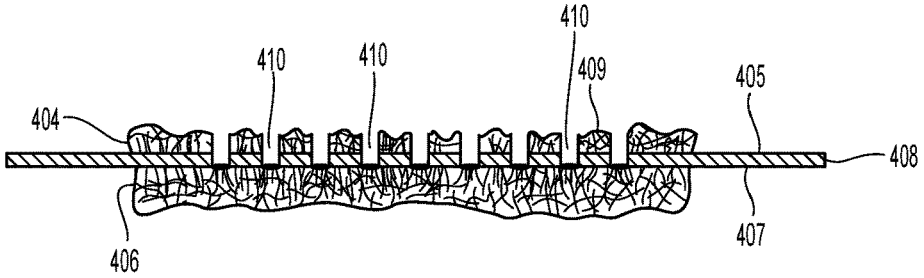
FIG. 10 is a schematic representation of an embodiment of an embossed fabric containing a barrier layer after embossing.

Referring to FIG. 9, in one embodiment, an upper fibrous layer 404 is placed on an upper face 405 of an impervious or low-permeability barrier or barrier layer 408, and a lower fibrous layer 406 is placed on the lower face 407 of the barrier layer opposite the upper face. An embossing tool 402 having a desired pattern is lowered in the direction of arrows B onto the upper fibrous layer. Referring to FIG. 10, this results in an embossed upper fibrous layer having a plurality of indentations 410 that drive fibers from the upper fibrous layer into the barrier layer. The barrier layer is melted within these indentations, and holes are punched through. Therefore, fibers from the face or upper fibrous layer on which fluid or dye solutions or dispersions are applied are forced into the indentations, i.e., bond points, or areas penetrating or breaking the barrier in those areas and at least partially through the barrier into the lower fibrous layer.

In one embodiment, the upper fibrous layer and impervious film are embossed into each other with heat or pressure or by ultrasonic action. In one embodiment, the indentations or compressed areas are subsequently and separately perforated to facilitate the passage of vacuum air flow and fluid through the impervious film. Vacuum is applied to the back of the embossed fabric, pulling dye through the upper fibrous layer toward the plurality of holes.

Figure 11:
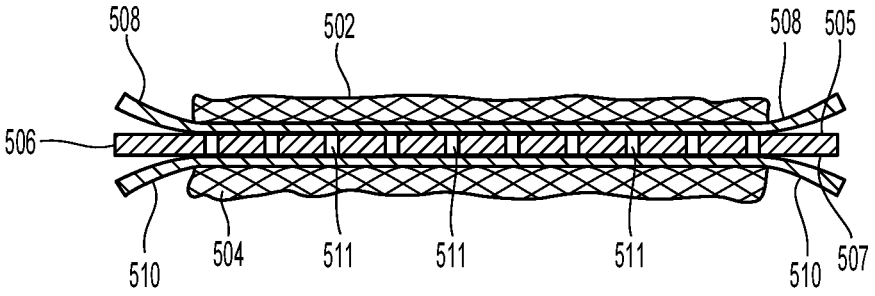
FIG. 11 is a schematic representation of an embodiment of a two-layer fabric with an intermediate barrier layer having a pre-defined arrangement of holes.
Figure 12:
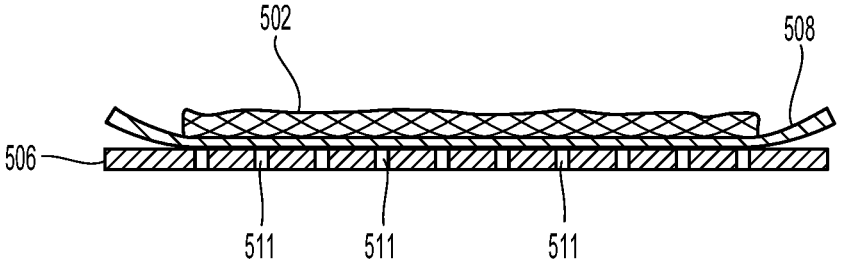
FIG. 12 is a schematic representation of an embodiment of a single-layer fabric with an attached barrier layer having a pre-defined arrangement of holes.

Referring now to FIG. 11, an upper fibrous layer 502 is placed on a top side 505 of a barrier layer 506, and a lower fibrous layer 504 is placed on a bottom side 507 of the barrier layer opposite the top side. An upper intermediate adhesive layer 508 is placed between the upper fibrous layer and the barrier layer, and a lower intermediate adhesive layer 510 is placed between the lower fibrous layer and the barrier layer. The upper and lower fibrous layers are combined by laminating with the intermediate adhesive layers. The barrier layer is originally impervious or has low air permeability, and may remain impervious or continue to have low-permeability after being combined with the outer fibrous layers or fabrics. A plurality of holes 511 are formed in the barrier layer before the layers are combined, or as the layers are combined, or after the layers are combined. Vacuum is applied to the lower fibrous layer of the fabric, pulling dye through the upper fibrous layer toward the plurality of holes. Referring to FIG. 12, in one embodiment, only the upper fibrous layer 502 is placed on the barrier layer 506 and attached with the upper intermediate adhesive layer 508.

In one embodiment, vacuum is selectively applied to different degrees or in different strengths at different areas to create decorative variations in color, tone, and depth. In one embodiment, variations of color or tone are created using a barrier layer having a variable predetermined pattern of perforations or holes formed in the barrier layer. The density of perforations defines the amount of vacuum air flow, and certain areas will have more holes or larger holes to allow more penetration over other areas when the vacuum is applied from underneath, i.e., to the opposite fibrous layer.

Figure 13:
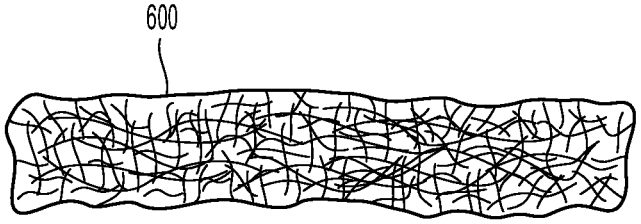
FIG. 13 is a schematic representation of an embodiment of a bulky fabric.
Figure 14:
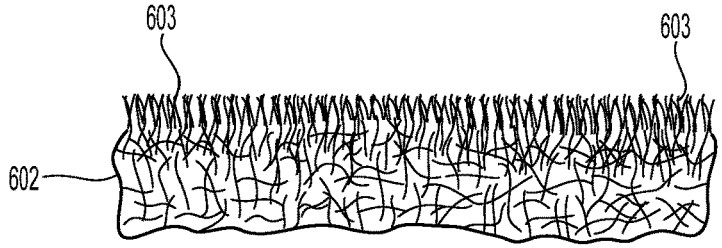
FIG. 14 is a schematic representation of an embodiment of a bulked and brushed fabric.
Figure 15:
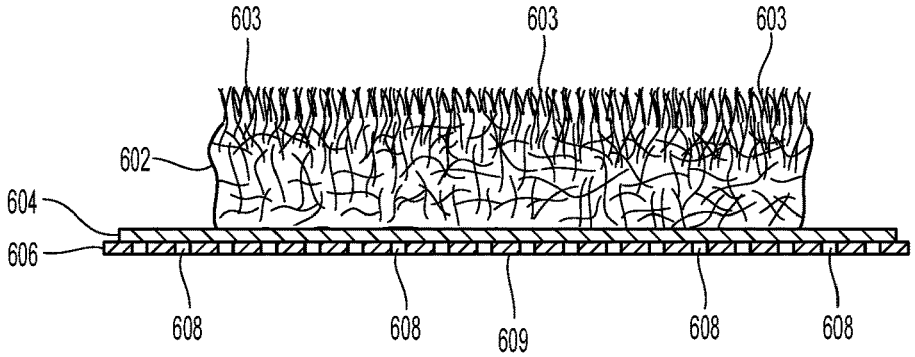
FIG. 15 is a schematic representation of an embodiment of a bulky brushed fabric attached to a barrier layer having a pre-defined arrangement of holes.

Embodiments are also directed to bulked or brushed woven, knit and other fabrics. A bulked fabric 600 is illustrated in FIG. 13, and a bulked and brushed fabric 602 having plurality of standing fibers 603 is illustrated in FIG. 14. As illustrated in FIG. 15, a bulked and brushed fabric 602 is permanently or temporarily attached to a pre-perforated or post perforable barrier layer 606 containing a plurality of holes 608 arranged in the desired pattern. In one embodiment, the brushed fabric layer is attached using an intermediate adhesive layer 604. Dye is applied to the top, i.e., the standing fibers 603, and vacuum is applied to the bottom side 609 of the barrier layer before the dye dries. In one embodiment, the perforated barrier layer remains attached to the face fabric following application of the dye under vacuum and drying of the dye. Alternatively, the barrier layer, being temporarily attached, is removed following vacuum dye application and is reused or discarded. In one embodiment temporary attachment involves the use of a very thin intermediate layer with a very low melt point that can be removed after the application, stabilization and setting of the dye by reheating. In one embodiment, the barrier layer is a thin film, such as a very thin but sturdy polyester films costing as little as a few cents per square yard.

Figure 16:
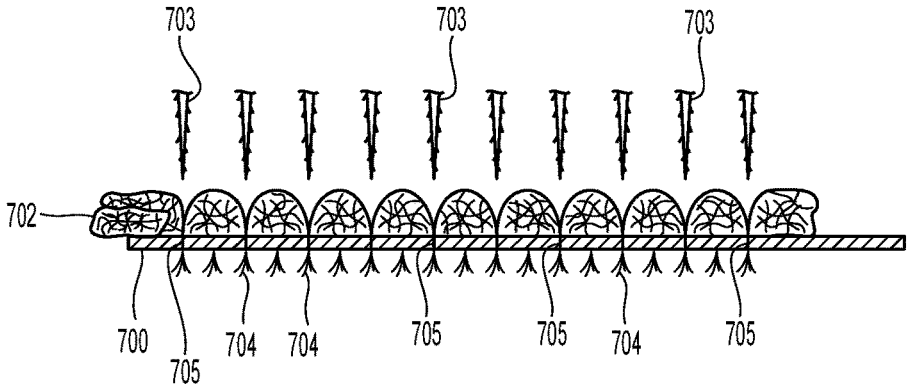
FIG. 16 is a schematic representation of an embodiment of a fabric with an enclosed barrier layer with fibers driven through the barrier layer with a plurality of widely spaced needles.

Referring now to FIG. 16, in one embodiment, a barrier layer 700 is attached to the bottom of a needlepunched felt or other textile layer 702 using a plurality of coarse needles 703 spaced at relatively large intervals, pushing fibers 704 through the barrier layer as loose tufts. The needles also form holes 705 in the barrier layer. This light needle punching does not necessarily form a contiguous lower layer, although the size and number of the tufts 704 are sufficient to allow the attachment of the barrier to the fabric. The perforated barrier layer, in addition to helping uniformize printing through and across the fabric, stabilizes the fabric dimensionally.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for printing a textile product, the method comprising:

combining a textile layer having a first face and a second face opposite the first face with a barrier layer comprising zero air permeability, the barrier layer spaced from at least one of the first face and the second face;

establishing a plurality of holes in the barrier layer;

applying dye to at least a portion of the first face of the fabric;

using vacuum applied from the second face to pull the dye through the textile layer and the plurality of holes in the barrier layer; and setting the dye;

wherein combining the textile layer with the barrier layer occurs prior to establishing the plurality of holes, applying the dye and using vacuum.

2. The method of claim 1, wherein establishing the plurality of holes further comprises establishing a sufficient number of holes to increase the air permeability of the barrier layer by a factor of at least two.

3. The method of claim 1 wherein:

the textile layer comprises at least one of exposed fibers and exposed yarns on the first face; and establishing the plurality of holes further comprises pushing at least one of the exposed fibers and the exposed yarns through the barrier layer to establish the plurality of holes.

4. The method of claim 1, wherein:

the textile layer comprises a stitchbonded fabric comprising yarns; and establishing the plurality of holes further comprises stitching the yarns through the barrier layer.

5. The method of claim 1, wherein:

the textile layer comprises a tufted fabric comprising a plurality at least one of individual fibers and yarns; and establishing the plurality of holes further comprises using tufting needles to drive at least one of the individual fibers and yarns though the barrier layer.

6. The method of claim 1, wherein:

the textile layer comprises a fibrous layer comprising a plurality of at least one of fibers and yarns; and establishing the plurality of holes further comprises using an embossing tool to drive at least one of fibers and yarns through the barrier layer.

7. The method of claim 1, wherein:

the textile layer comprises a needlepunched fabric comprising a plurality of fibers; and establishing the plurality of holes further comprises using a plurality of coarse needles to push fibers through the barrier layer.

8. The method of claim 1, wherein the barrier layer is in contact with the second face of the textile layer.

9. The method of claim 1, wherein combining the textile layer with the barrier layer further comprising combining a first textile layer and a second textile layer with the barrier layer, the barrier layer disposed between the first textile layer and the second textile layer.

10. The method of claim 9, wherein:

applying dye further comprises applying dye to the first textile layer; and using vacuum further comprises using vacuum applied from the second textile layer to pull the dye into or through the first textile layer and the plurality of holes in the barrier layer.

11. The method of claim 1, wherein establishing the plurality of holes further comprises establishing the plurality of holes having a uniform size in the barrier layer in a uniform pattern across the barrier layer.

12. The method of claim 1, wherein establishing the plurality of holes further comprises establishing the plurality of holes having two or more sizes in the barrier layer in a variable pattern across the barrier layer.

13. The method of claim 1, wherein using vacuum further comprises using vacuum applied uniformly across the second face of the textile layer.

14. The method of claim 1, wherein using vacuum further comprises using vacuum applied to the second face at more than 25 cm of water.

15. The method of claim 1, wherein using vacuum further comprises using vacuum applied simultaneously at different levels in different areas across the second face.

16. The method of claim 1, wherein using vacuum further comprises using vacuum applied sequentially to a plurality of discrete locations across the second surface.

17. The method of claim 1, wherein the method further comprises compressing the textile product after applying dye and using vacuum and before setting the dye.

18. The method of claim 17, wherein compressing the textile product further comprising using a plurality of levels of compression, each level of compression applied at a discrete location across the second face.

19. The method of claim 1, wherein the method further comprises blowing compressed air onto the applied dye before, during or after the application of vacuum.

20. A method for printing a textile product, the method comprising:

combining a textile layer having a first face comprising fibers and a second face opposite the first face with a barrier layer, the barrier layer spaced from at least one of the first face and the second face;

pushing the fibers through the barrier layer to establish a plurality of holes in the barrier layer, the plurality of holes sufficient to increase an air permeability of the barrier layer by a factor of at least two;

applying dye to at least a portion of the first face of the fabric;

using vacuum applied from the second face to pull the dye through the textile layer and the plurality of holes in the barrier layer; and setting the dye.

21. A method for printing a textile product, the method comprising:

combining a textile layer formed by yarns and having a first face and a second face opposite the first face with a barrier layer, the barrier layer spaced from at least one of the first face and the second face;

establishing a plurality of holes in the barrier layer by pushing the yarns through the barrier layer to establish the plurality of holes;

applying dye to at least a portion of the first face of the fabric;

using vacuum applied from the second face to pull the dye through the textile layer and the plurality of holes in the barrier layer; and setting the dye.

22. A method for printing a textile product, the method comprising:

combining a textile layer comprising a stitchbonded fabric comprising yarns, a first face and a second face opposite the first face with a barrier layer comprising zero air permeability, the barrier layer spaced from at least one of the first face and the second face;

stitching the yarns through the barrier layer to establish a plurality of holes in the barrier layer;

applying dye to at least a portion of the first face of the fabric;

using vacuum applied from the second face to pull the dye through the textile layer and the plurality of holes in the barrier layer; and setting the dye.

23. A method for printing a textile product, the method comprising:

combining a textile layer comprising a tufted fabric comprising a plurality at least one of individual fibers and yarns, a first face and a second face opposite the first face with a barrier layer comprising zero air permeability, the barrier layer spaced from at least one of the first face and the second face;

using tufting needles to drive at least one of the individual fibers and yarns though the barrier layer to establish a plurality of holes in the barrier layer;

applying dye to at least a portion of the first face of the fabric;

using vacuum applied from the second face to pull the dye through the textile layer and the plurality of holes in the barrier layer; and setting the dye.

24. A method for printing a textile product, the method comprising:

combining a textile layer comprising a fibrous layer comprising a plurality of at least one of fibers and yarns, a first face and a second face opposite the first face with a barrier layer comprising zero air permeability, the barrier layer spaced from at least one of the first face and the second face;

using an embossing tool to drive at least one of fibers and yarns through the barrier layer to establish a plurality of holes in the barrier layer;

applying dye to at least a portion of the first face of the fabric;

using vacuum applied from the second face to pull the dye through the textile layer and the plurality of holes in the barrier layer; and setting the dye.

25. A method for printing a textile product, the method comprising:

combining a textile layer comprising a needlepunched fabric comprising a plurality of fibers, a first face and a second face opposite the first face with a barrier layer comprising zero air permeability, the barrier layer spaced from at least one of the first face and the second face;

using a plurality of coarse needles to push fibers through the barrier layer to establish a plurality of holes in the barrier layer;

applying dye to at least a portion of the first face of the fabric;

using vacuum applied from the second face to pull the dye through the textile layer and the plurality of holes in the barrier layer; and setting the dye.

* * * * *